US010529259B1

(12) United States Patent
Kiehart, III

(10) Patent No.: US 10,529,259 B1
(45) Date of Patent: Jan. 7, 2020

(54) TRAFFIC SIGN WITH SLIDING PANELS

(71) Applicant: DBI Services, Inc., Hazelton, PA (US)

(72) Inventor: John E. Kiehart, III, Hazelton, PA (US)

(73) Assignee: DBI Services, LLC, Hazelton, PA (US)

( * ) Notice: Subject to any disclaimer, the term of this patent is extended or adjusted under 35 U.S.C. 154(b) by 0 days.

(21) Appl. No.: 16/280,082

(22) Filed: Feb. 20, 2019

(51) Int. Cl.

| | |
|---|---|
| ***G09F 21/00*** | (2006.01) |
| ***G09F 7/20*** | (2006.01) |
| ***G09F 21/04*** | (2006.01) |
| *G09F 7/18* | (2006.01) |

(52) U.S. Cl.
CPC ..... *G09F 7/20* (2013.01); *G09F 21/04* (2013.01); *G09F 2007/1865* (2013.01); *G09F 2007/1878* (2013.01)

(58) Field of Classification Search
CPC .... G09F 7/20; G09F 21/04; G09F 2007/1878; G09F 2007/1865
See application file for complete search history.

(56) References Cited

U.S. PATENT DOCUMENTS 1,044,750 A * 11/1912 Coleman ..... G09F 11/26 40/525
1,498,310 A * 6/1924 Walz ..... B60Q 1/34 116/42
1,548,450 A * 8/1925 Fitch ..... 116/63 R
1,656,192 A * 1/1928 Guttin ..... B60Q 1/34 116/44
1,684,207 A * 9/1928 Smyth ..... G08G 1/096716 340/907
1,974,690 A * 9/1934 Plunkett ..... G09F 11/00 40/491
2,312,074 A * 2/1943 Campbell ..... G08G 1/096716 340/907
2,770,900 A * 11/1956 Smith ..... G04C 23/00 343/730
2,850,717 A * 9/1958 Wiswell ..... G08G 1/095 40/488
5,177,713 A * 1/1993 Doughty ..... G04B 19/24366 368/28
5,518,409 A * 5/1996 White ..... B42D 9/001 116/234
6,748,685 B2 * 6/2004 Peel ..... G09F 11/18 40/471
6,978,565 B1 * 12/2005 Tollius ..... G09F 11/00 283/99

* cited by examiner

*Primary Examiner* — Cassandra Davis
(74) *Attorney, Agent, or Firm* — J. Wiley Horton

(57) ABSTRACT

A sign incorporating a fixed panel with multiple windows. A moving panel is provided behind each window. Each moving panel includes multiple messages. By moving a particular moving panel with respect to its associated window, a different message can be displayed through the window. A control system is provided for controlling the position of the moving panels. This control system is preferably remotely located, so that a user can operate the inventive sign from a safe position.

20 Claims, 15 Drawing Sheets

TRAFFIC SIGN WITH SLIDING PANELS

CROSS-REFERENCES TO RELATED APPLICATIONS

Not applicable

STATEMENT REGARDING FEDERALLY SPONSORED RESEARCH OR DEVELOPMENT

Not applicable

MICROFICHE APPENDIX

Not applicable

BACKGROUND OF THE INVENTION

1. Field of the Invention

This invention relates to the field of highway construction and maintenance. More specifically, the invention comprises a portable traffic sign incorporating sliding panels that allow the message on the sign to be remotely changed.

2. Description of the Related Art

Traffic signs are used for many purposes during highway construction and maintenance. One application is the use of a traffic sign on a truck at the initial point where a lane or shoulder is to be closed. The truck can be moved as the work progresses. FIG. 1 shows a typical prior art sign truck 10. A wide variety of such trucks are in use. The example shown in FIG. 1 is a short wheelbase, flatbed truck modified to carry signs and a collision attenuator. Attenuator 16 is mounted proximate the rear of bed 12.

Flashing arrow sign 18 is mounted in an elevated position behind cab 14. Fixed text sign 20 is typically mounted in a lower position. Flashing arrow sign 18 is used to inform oncoming traffic of the need to merge in the case of a lane closure. Fixed text sign 20 often specifies the type of closure (shoulder or lane). Storage is often provided on bed 12 for multiple different fixed text signs 20. The fixed text sign is often held within a frame that allows the sign to be quickly changed.

As an example, a crew might be working along the right shoulder of a highway for the first part of a night and then need to work in the right lane itself. A "SHOULDER CLOSED" sign would be displayed for the first part of the night. At some point the crew would change to an alternate "LANE CLOSED" sign. In order to do this, the sign truck crew must exit the cab and climb onto the bed's work area. This can be a dangerous task. The sign truck is intended to be the first point of the work area encountered by the traffic (hence the inclusion of crash attenuator 16). It is in the area where an inattentive motorist may fail to reduce speed and cause a disastrous collision. Thus, it is generally undesirable to have the crew leave the cab. It would be preferable to be able to change the sign without exiting the cab.

It is known in the art to use sophisticated electronic displays in order to provide a variable message to the oncoming traffic. Such displays are expensive. In addition, any sign or display will be exposed to a hostile environment including wind blast, thrown debris, and inclement weather. It is preferable to provide a changeable display using simple and robust technology.

Further, the Manual on Uniform Traffic Control Devices ("MUTCD") requires the use of a sign having a standardized appearance. It is therefore desirable to provide a changeable sign that also conforms to the MUTCD standards. The present invention provides such a solution.

BRIEF SUMMARY OF THE PRESENT INVENTION

The present invention comprises a sign incorporating a fixed panel with multiple windows. A moving panel is provided behind each window. Each moving panel includes multiple messages. By moving a particular moving panel with respect to its associated window, a different message can be displayed through the window.

A control system is provided for controlling the position of the moving panels. This control system is preferably remotely located, so that a user can operate the inventive sign from a safe position.

REFERENCE NUMERALS IN THE DRAWINGS

Figure 1:
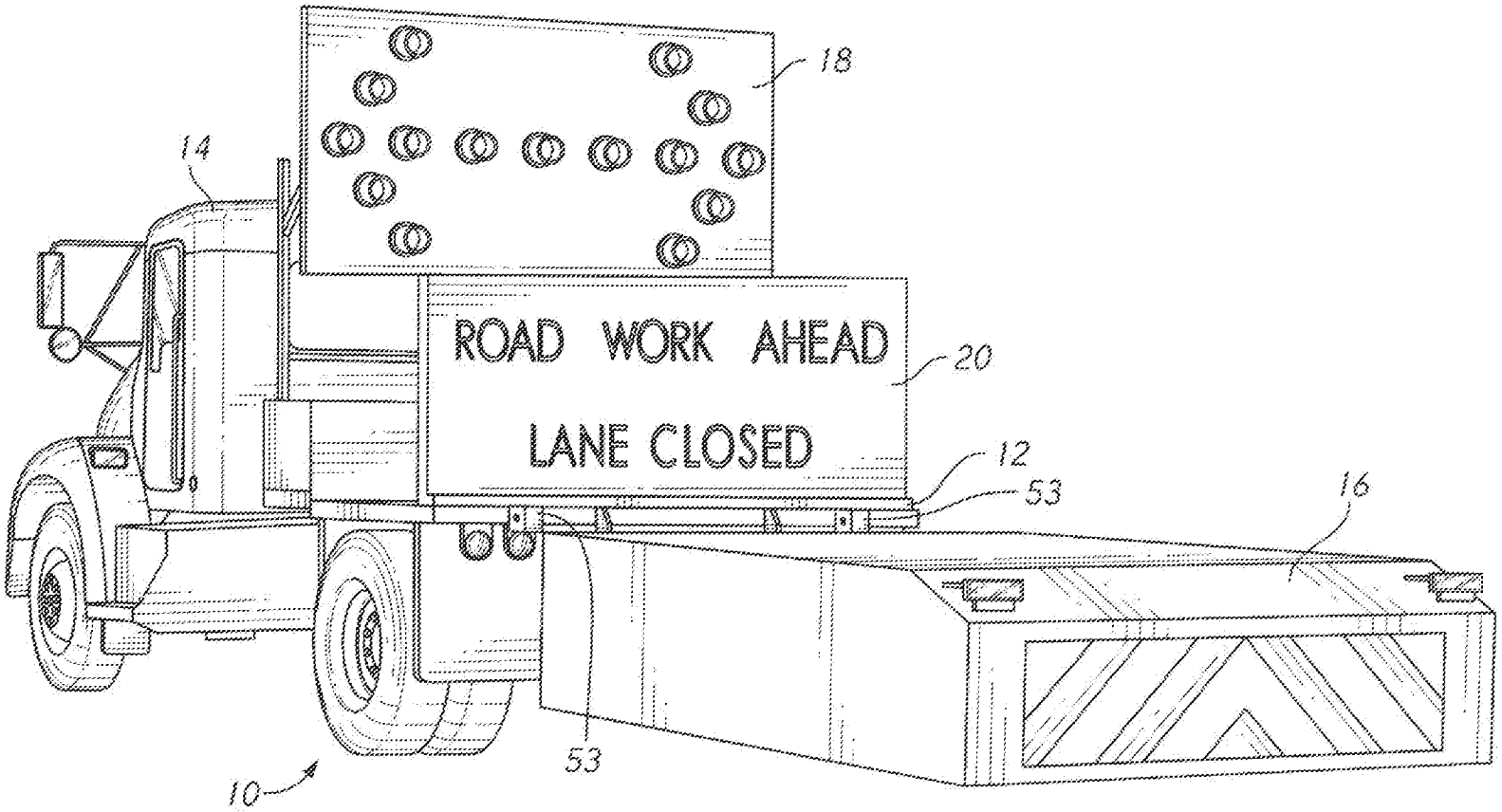
FIG. 1 (PRIOR ART)
FIG. 1 is a perspective view, showing a prior art sign truck.

10 sign truck
12 bed
14 cab
16 attenuator
18 flashing arrow sign
20 fixed text sign
22 sign chassis
24 fixed panel
25 variable text sign

26 first moving panel
28 second moving panel
30 first window
31 left upper limit switch bracket
32 second window
33 left lower limit switch bracket
34 first variable message area
35 right upper limit switch bracket
36 second variable message area
37 right lower limit switch bracket
38 third variable message area
40 fourth variable message area
42 first fixed message area
44 second fixed message area
46 first moving panel frame
48 second moving panel frame
50 mounting leg
52 linear guide
53 receiver
54 bracket
58 first linear actuator
59 linear bearing
60 second linear actuator
62 bracket
64 bracket
66 power and control cable
68 control box
70 power input cable
72 cigar lighter adapter
74 first toggle switch
76 second toggle switch
78 first status light
80 second status light
82 third status light
84 fourth status light
86 set screw
88 left upper limit switch
89 limit switch wiring
90 left lower limit switch
92 control circuit
94 right upper limit switch
96 right lower limit switch
98 power source
100 breaker
102 lower bracket
104 upper bracket
106 lower square tube
108 middle square tube
110 upper square tube
112 extension rod
114 hole
116 hole
118 fastener
120 fastener
122 moving panel bracket
124 hole
126 hole
128 trailer

DETAILED DESCRIPTION OF THE INVENTION

Referring again to FIG. 1, the present invention replaces fixed text sign 20 with a sign incorporating movable elements. These movable elements can be altered to change the message presented. The alteration can preferably be made without an operator having to exit the cab of the sign truck.

Figure 2:
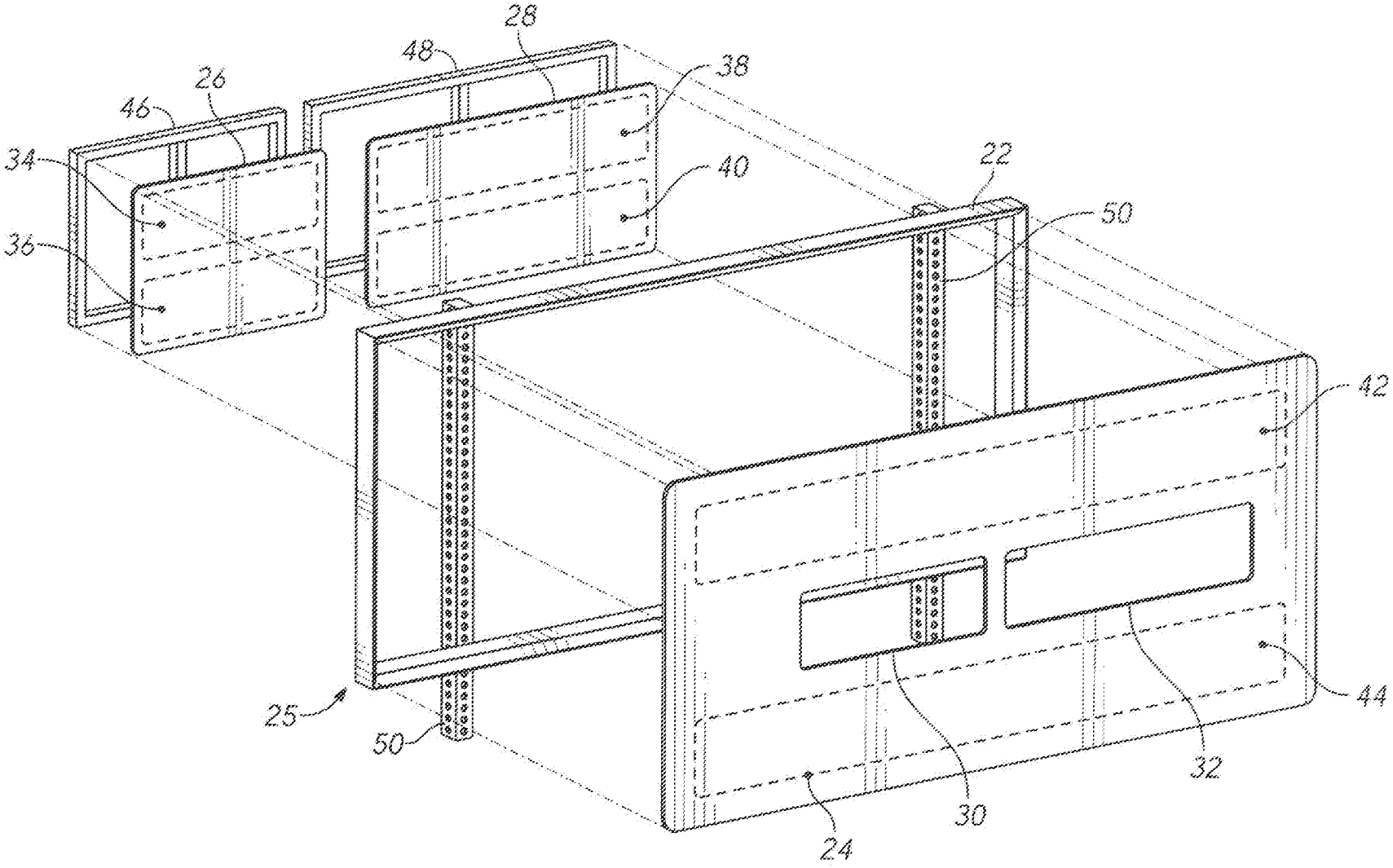
FIG. 2 is an exploded perspective view, showing some major components of the present invention.

FIG. 2 provides an exploded perspective view of an embodiment of the inventive variable text sign 25. The variable text sign in this example is configured to easily replace the fixed text sign shown in the assembly of FIG. 1. Sign chassis 22 provides a mounting structure for the other components. Two mounting legs 50 are attached to the sign chassis, with a portion of each mounting leg extending beyond the bottom of the sign chassis. Returning briefly to FIG. 1, the reader will note that sign truck 10 has a pair of hollow square receivers 53 attached to the rear of bed 12. This type of receiver is typically just a piece of square tubing that is welded to the rear of the bed. It may also include transverse holes that permit the use of a cross pin to adjust the height of the sign.

Looking again at FIG. 2, the reader will observe how the portions of mounting legs 50 extending below sign chassis 22 are configured to slide down into the receivers 53 on the rear of the sign truck bed. Mounting legs 50—in this example—are equipped with a series of transverse holes corresponding to transverse holes found in receivers 53. These allow the insertion of a locking pin to fix the height of the sign. The mounting structures shown are merely one example out of a wide range of possibilities, and the invention is by no means limited to any particular mounting structure.

Fixed panel 24 attaches to the rearward-facing side of sign chassis 22. In this embodiment fixed panel 24 contains two windows—first window 30 and second window 32. These windows provide an opening for the display of a changeable message. In many embodiments the sign will incorporate a non-changing portion of the overall message. First fixed message area 42 and second fixed message area 44 are provided for displaying fixed portions of the message.

First moving panel 26 is designed to lie immediately behind the back of fixed panel 24. By moving up and down, first moving panel 26 can display either first variable message area 34 or second variable message area 36 through first window 30. In a similar arrangement second moving panel 28 is designed to lie immediately behind fixed panel 24. By moving up and down, second moving panel 28 can display either third variable message area 38 or fourth variable message area 40 through second window 32.

In this example first moving panel 26 is mounted on first mounting panel frame 46. Likewise, second moving panel 28 is mounted on second moving panel frame 48. An actuating system is needed to move the panels 26, 28. The actuating system may assume many different forms.

Figure 3:
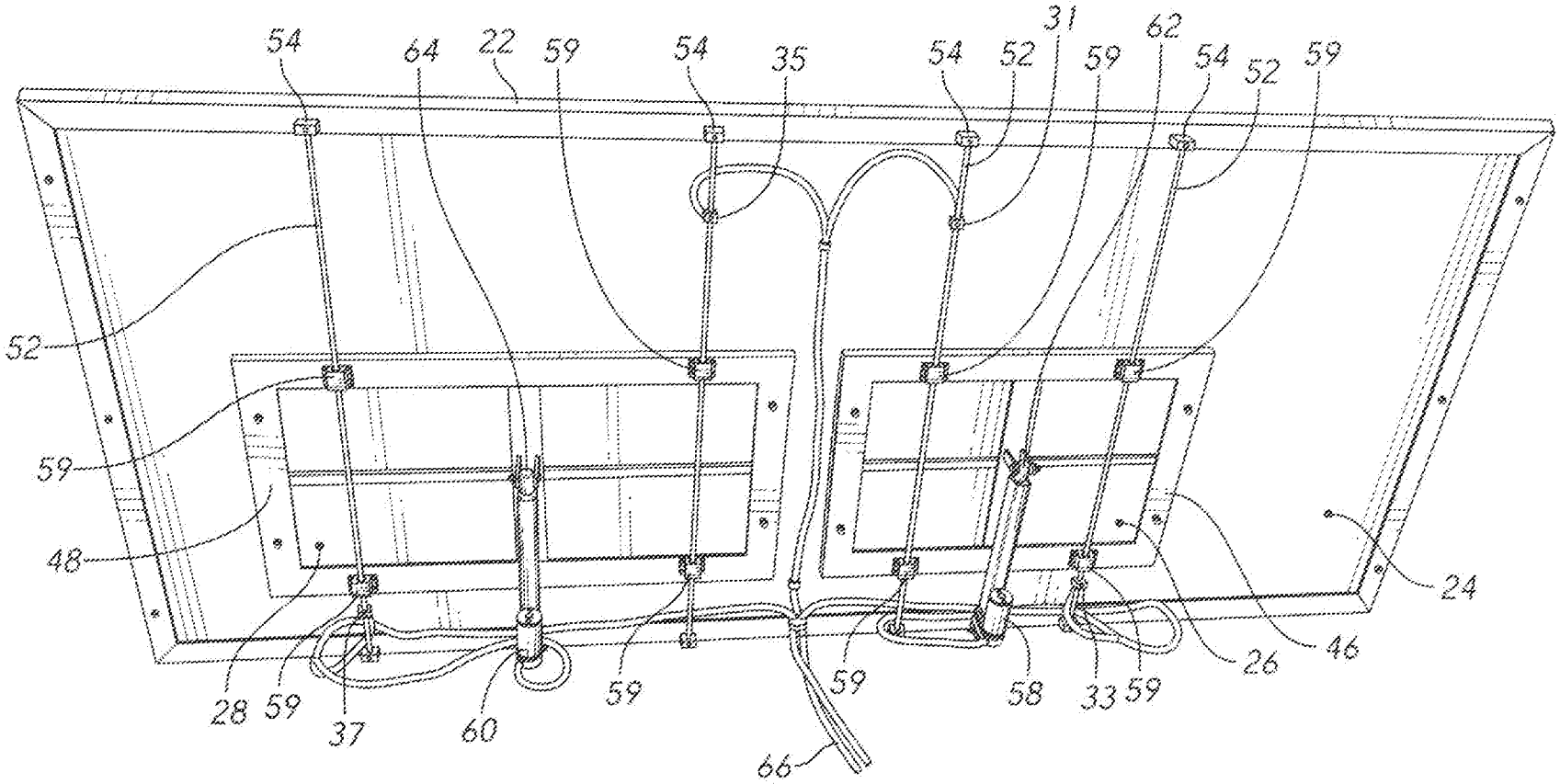
FIG. 3 is a perspective view, showing the rear of an embodiment of the present invention.

FIG. 3 provides a first example of an actuating system for the moving panels. FIG. 3 shows the back of chassis 22 and fixed panel 24 (Mounting legs 50 are omitted from the view for purposes of visual clarity). As stated previously, moving panels 26, 28 are mounted on moving panel frames 46, 48. Four vertically-oriented linear guides 52 are provided. The upper and lower ends of the linear guides 52 are connected to chassis 22 using brackets 54 to hold them securely in place. First moving panel frame 46 is equipped with four linear bearings 59 that slide along the two linear guides 52 proximate first moving panel 26. Likewise, second moving panel frame 48 is equipped with four linear bearings 59 that slide along the two linear guides 52 proximate second moving panel 28. In this context the term "linear bearing" should be understood to mean any device configured to slide smoothly along linear guide 52. It is not limited to a metal or plastic bushing, a sophisticated assembly including balls traveling in a bearing race, or any particular device.

The two moving panel frames 46, 48 are able to slide freely up and down with respect to chassis 22. An actuator is needed to position the moving panels. Because linear motion is needed, a linear actuator is preferred. In the example of FIG. 3, first linear actuator 58 is used to move first moving panel frame 46. This linear actuator includes an electric motor that drives an extending portion via a jackscrew mechanism. The extending portion is connected to first moving panel frame 46 via bracket 62. The fixed portion of first linear actuator 58 is connected to chassis 22. With these connections made, energizing the electric motor in a first direction will cause first moving panel frame 46 to move upward whereas energizing the electric motor in the opposite direction will cause first moving panel frame 46 to move downward. Jackscrew mechanisms have a high final drive ratio. Because of this fact, when electrical power is removed from the motor the jackscrew mechanism will remain in position until the motor is again activated. No separate securing device is needed.

A second linear actuator 60 is connected to second moving panel frame 48 by bracket 64. The second linear actuator in this example is the same type as the first linear actuator. Rotary motion of the electric motor within second linear actuator 60 positions second moving panel frame 48 as desired.

Figure 4A:
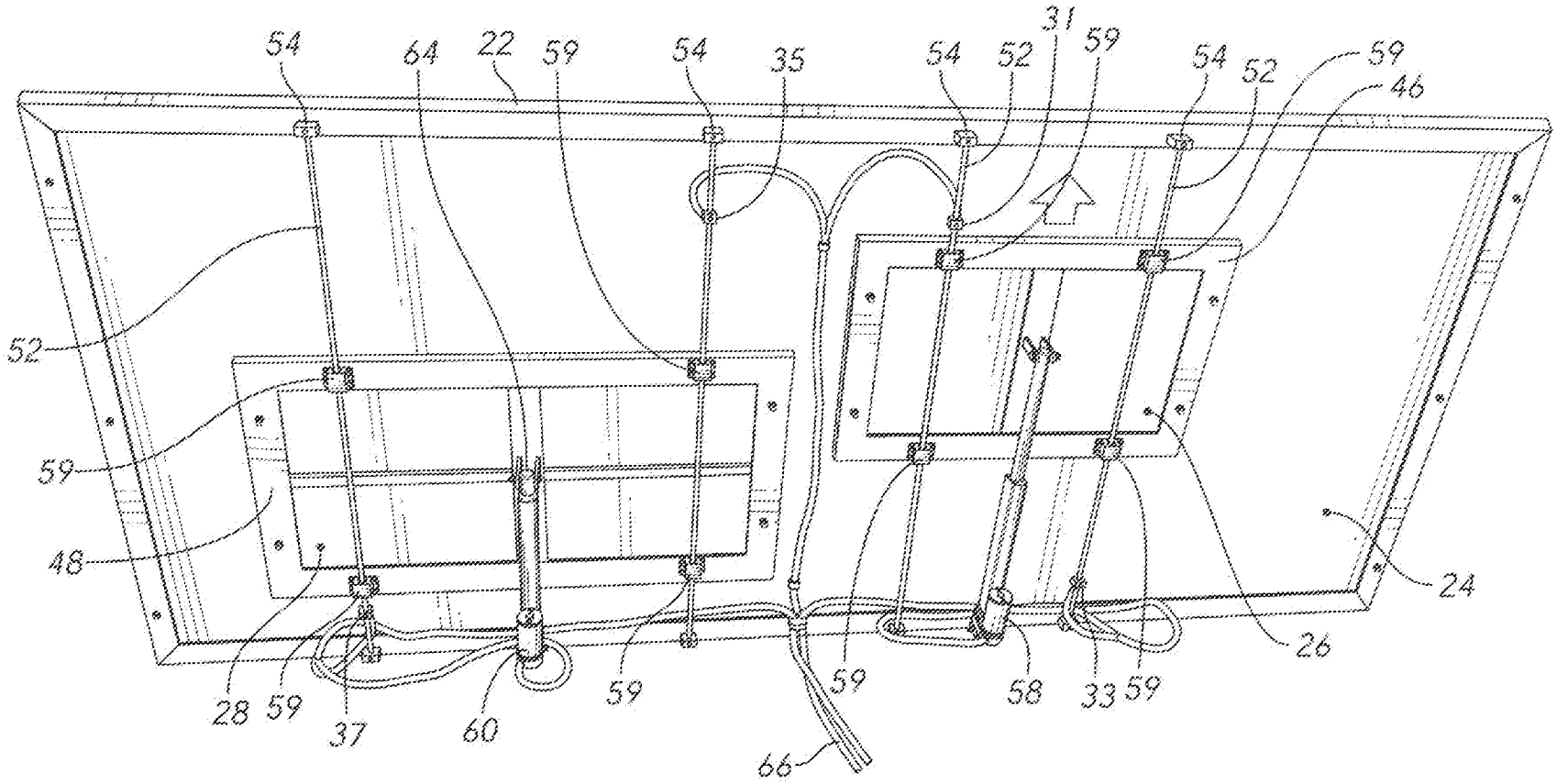
FIG. 4A is a perspective view, showing an alternate position for one of the moving panels.
Figure 4B:
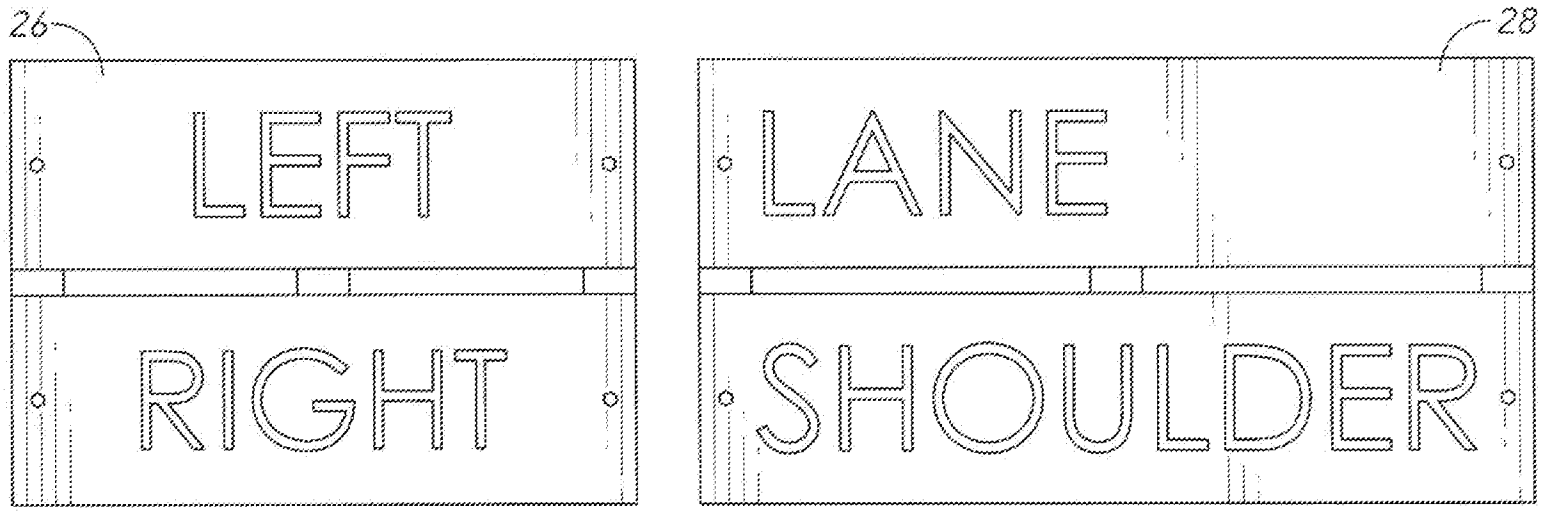
FIG. 4B is an elevation view, showing exemplary messages printed on the two moving panels in a preferred embodiment.

FIG. 4A depicts the assembly of FIG. 3 in motion. First linear actuator 58 has been energized to move first moving panel frame 46 upward—as indicated by the arrow. The reader will note how the arm of the jackscrew mechanism has extended out of the housing of first linear actuator 58 (and carried first moving panel frame 46 upward with it).

With the explanation of the inventive sign's structure and moving mechanisms, an example of how the sign can be used will be given. FIGS. 4B-8 depict two exemplary moving panel messages and how they can be displayed through the two windows in the variable text sign. First moving panel 26 includes the message "LEFT" in its upper portion and the message "RIGHT" in its lower portion. Second moving panel 28 includes the message "LANE" in its upper portion and the message "SHOULDER" in its lower portion.

Figure 5:
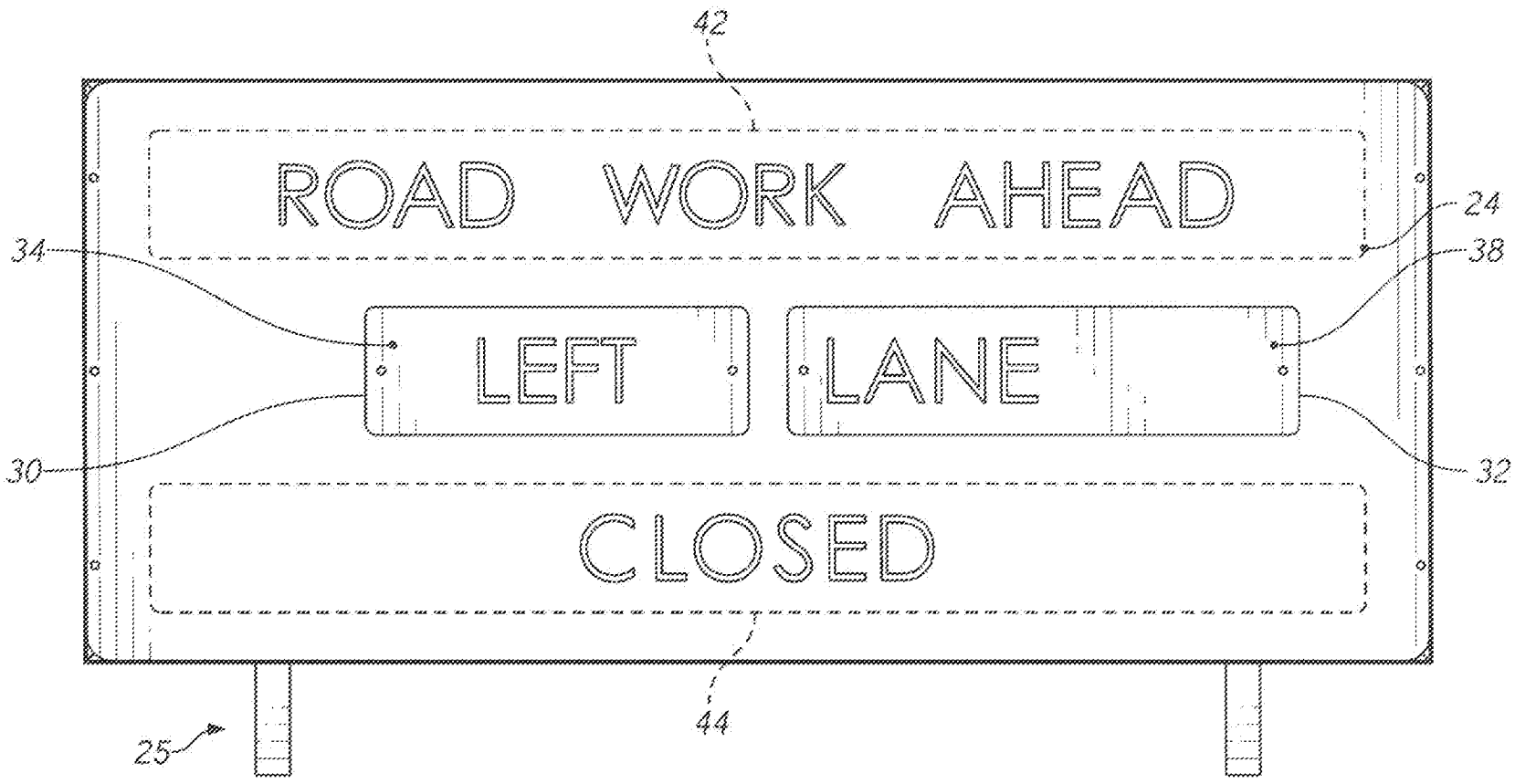
FIG. 5 is an elevation view, showing an embodiment in use.

FIG. 5 shows the inventive variable test sign 25 as it would appear to oncoming traffic. In FIG. 5, first moving panel 26 is in its low position so that the word "LEFT" is displayed through first window 30 (in first variable message area 34). Second moving panel 28 is also in its low position so that the word "LANE" is displayed through second window 32 (in third variable message area 38). In first fixed message area 42 the phrase "ROAD WORK AHEAD" is displayed. In second fixed message area 44 the word "CLOSED" is displayed. This combination creates the message "ROAD WORK AHEAD LEFT LANE CLOSED."

Figure 6:
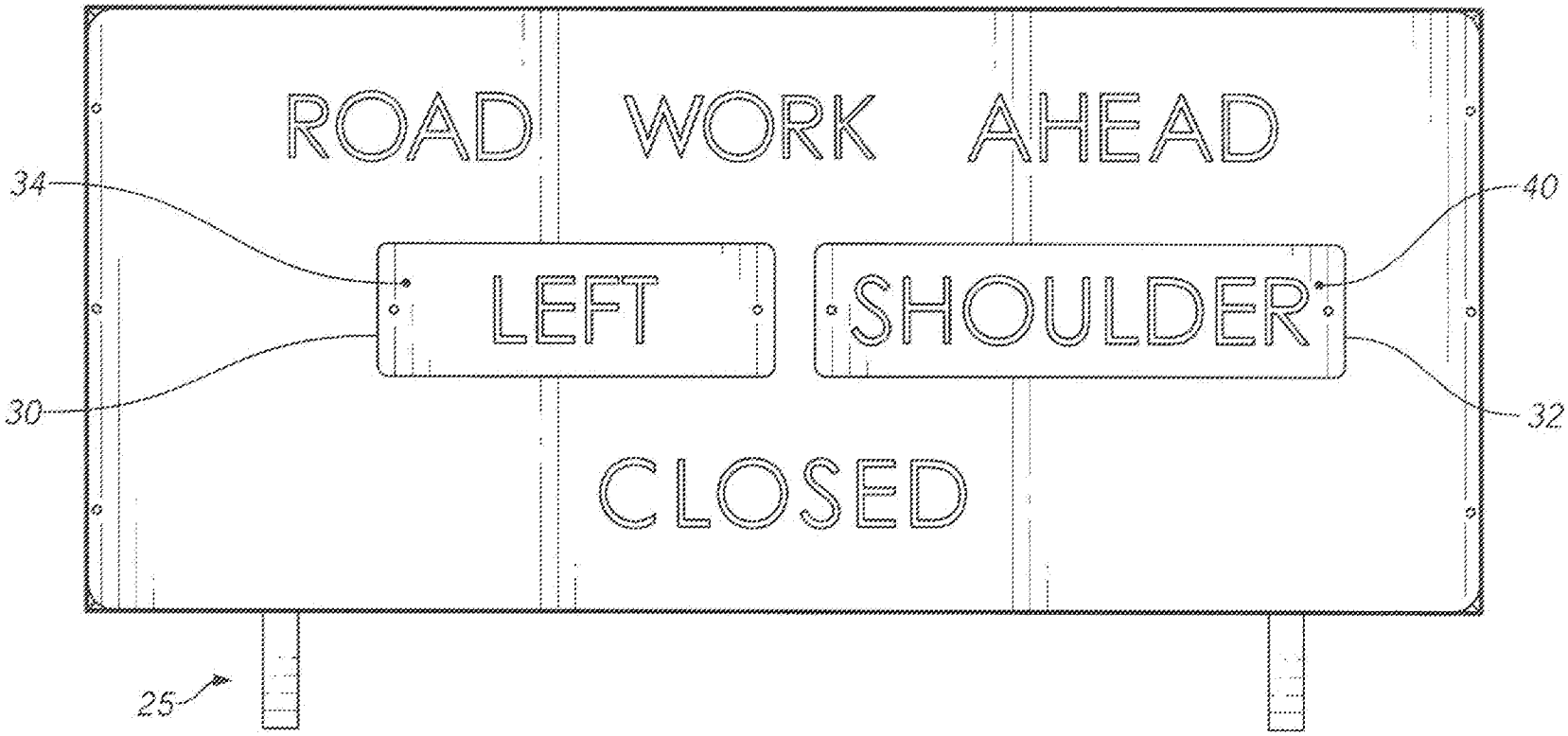
FIG. 6 is an elevation view, showing an embodiment in use.

FIG. 6 shows the same inventive sign embodiment after second moving panel 28 has been raised to its high position. The word "SHOULDER" is now displayed through second window 32 (in fourth variable message area 40). The first moving panel has not been moved and remains in its low position. This combination creates the message "ROAD WORK AHEAD LEFT SHOULDER CLOSED."

Figure 7:
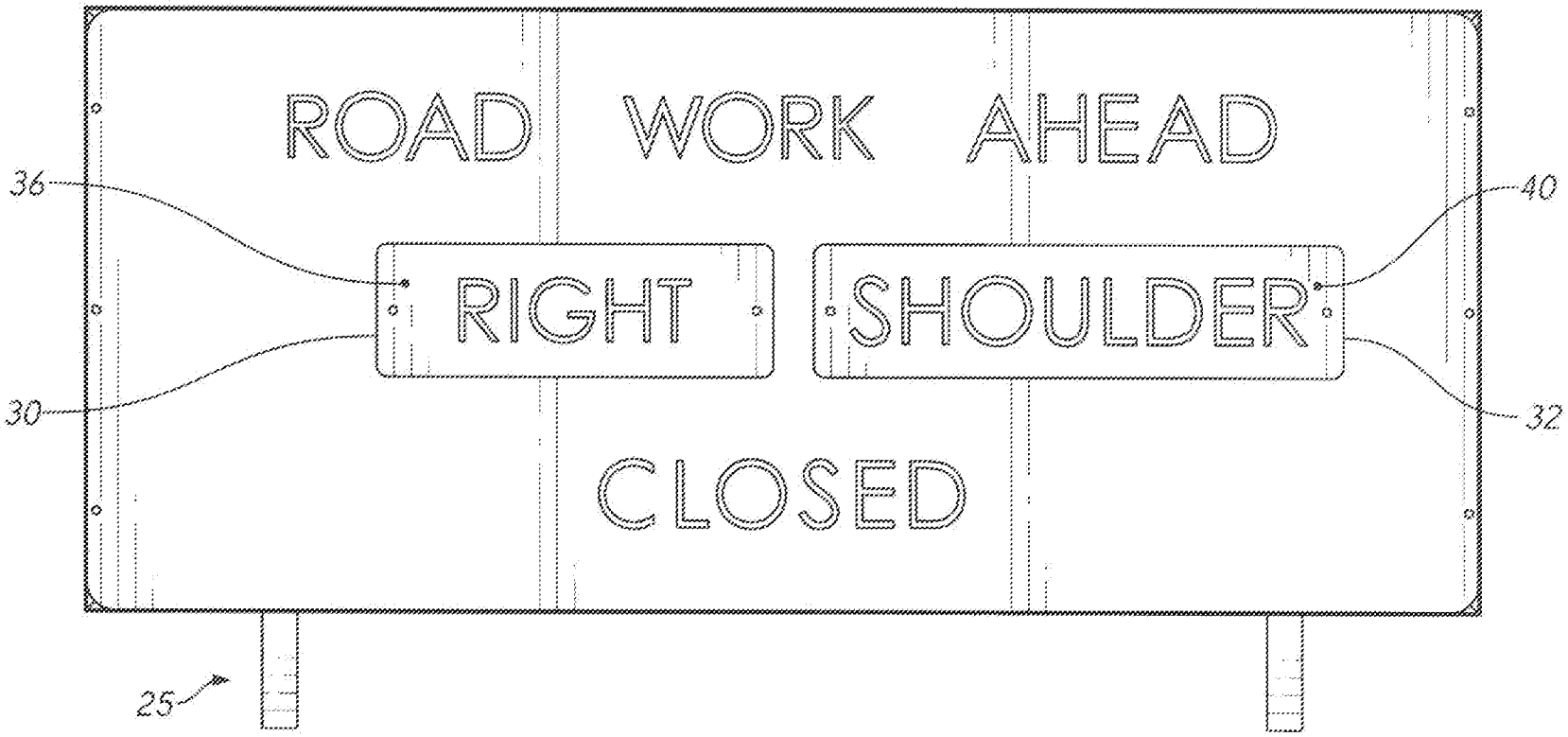
FIG. 7 is an elevation view, showing an embodiment in use.
Figure 8:
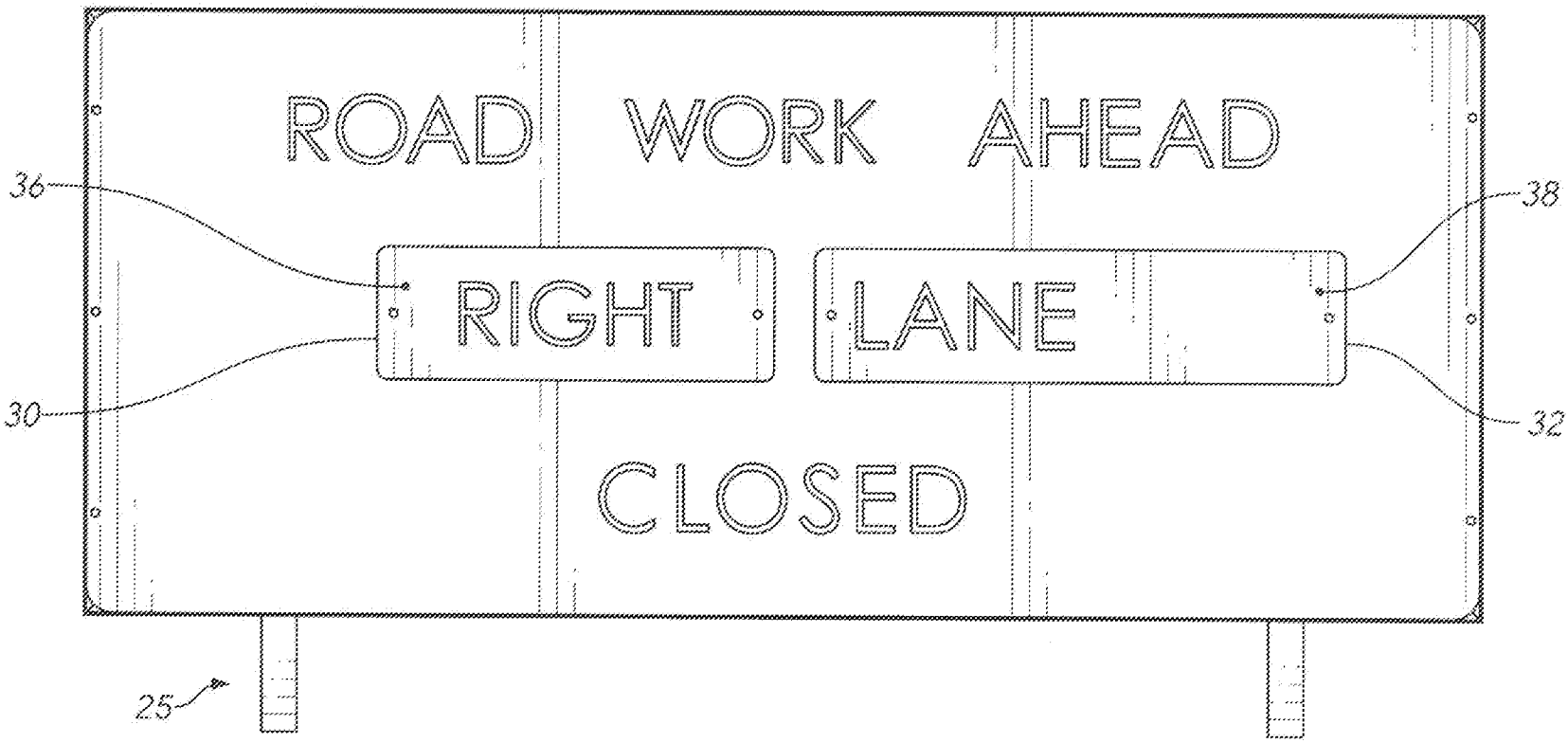
FIG. 8 is an elevation view, showing an embodiment in use.

FIG. 7 shows the same inventive sign embodiment after first moving panel 26 has been raised to its high position. The word "RIGHT" is now displayed through first window 30 (in second variable message area 36). The second moving panel remains in its high position. This combination creates the message "ROAD WORK AHEAD RIGHT SHOULDER CLOSED." In FIG. 8, second moving panel 28 has been moved to its low position. This combination creates the message "ROAD WORK AHEAD RIGHT LANE CLOSED."

The reader will appreciate that the variable text sign can be configured to present a virtually endless series of messages. The text within the fixed portions of the sign can be changed from the examples given. Likewise, the text in the movable portions of the sign can be changed from the examples given. However, it is important for the combination of the text in the fixed and movable portions to create a unified text message. The phrase "unified text message" means a message that reads as a unified whole. It may include two separate concepts, so long as the two separate concepts would naturally be presented together in a fixed sign. As an example, the messages "ROAD WORK AHEAD" and "RIGHT SHOULDER CLOSED" are two separate concepts that are often presented on a single sign (and would therefore be a "unified text message").

The motion of the moving panels may be controlled manually. It is preferable, however, to provide a system of automatic control so that a user can set a desired position and then have the control system move the panels to achieve that desired position. As those skilled in the art will know, the control system can assume many different forms. A simple example will be explained in detail, but the invention is by no means limited to this one example.

Figure 9:
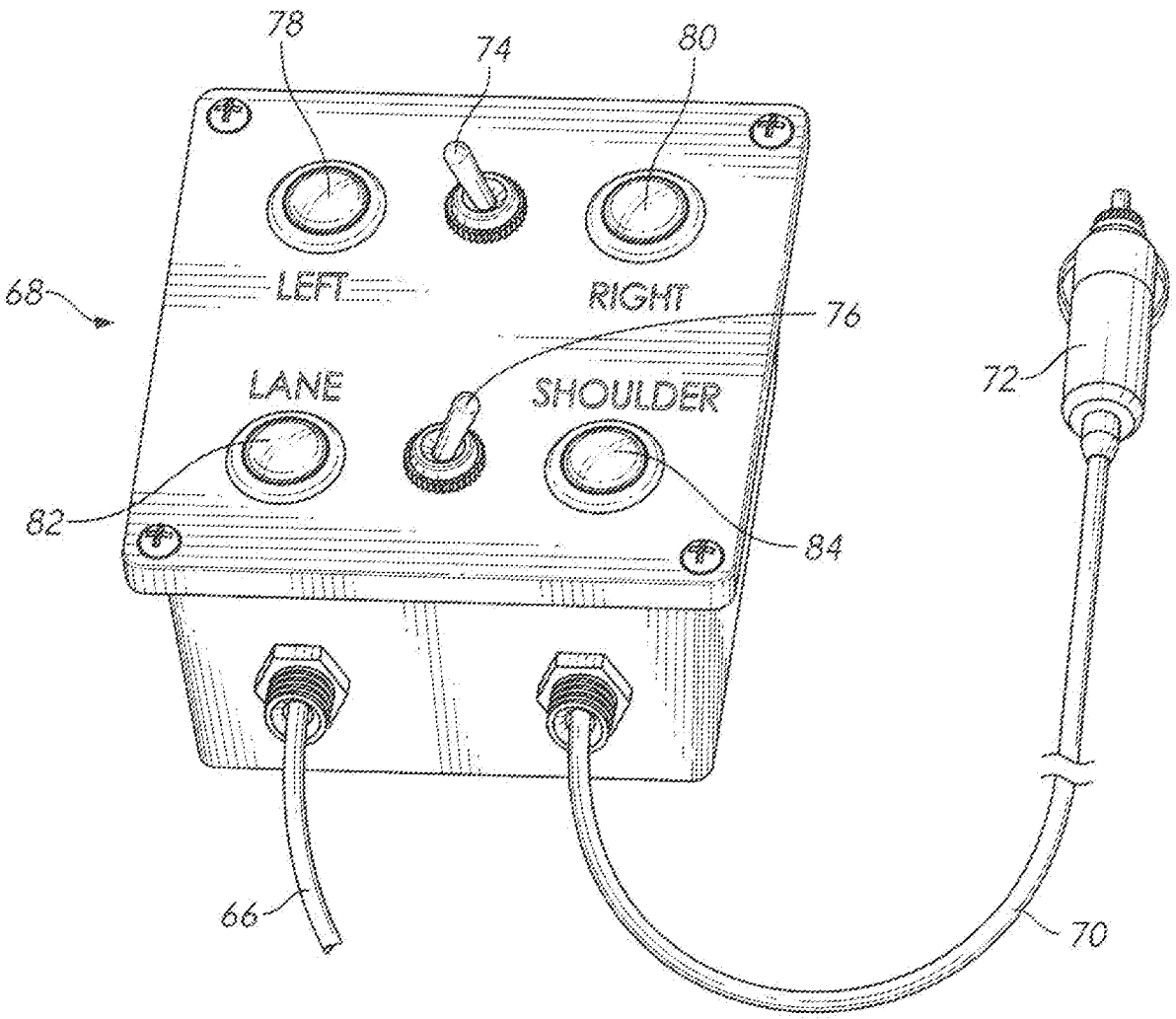
FIG. 9 is a perspective view, showing an embodiment of a control box used to operate the inventive sign.

FIG. 9 shows control box 68. In this example the control box is a ruggedized plastic enclosure that can remain inside the sign truck's cab or be carried outside. Power and control cable 66 leads from the control box to the inventive variable text sign. Power input cable 70 provides DC input power for purposes of running the control circuitry and running the actuators in the sign itself. Cigar lighter adapter 72 may be provided so that the control box can be plugged into a cigar lighter. Many utility vehicles include dedicated power plugs. One of these types of plugs may be provided as well.

Two switches are provided—first toggle switch 74 and second toggle switch 76. First toggle switch 74 controls the position of first moving panel 26. Second toggle switch 76 controls the position of second moving panel 28.

First status light 78 and second status light 80 are provided next to first toggle switch 74. Third status light 82 and fourth status light 84 are provided next to second toggle switch 76. The status lights act as "annunciators." These indicate the current position of the sign's movable panels. Text is printed next to these status lights. The text is meant to indicate what text is actually being shown on the sign when a status light is illuminated.

In this version, each toggle switch 74, 76 is of the double-pole/single-throw variety ("DPST"). Such a switch only has two positions. In the example of FIG. 9, the switches have been placed in the positions shown and the control system has operated to move the moving panels until they have come to rest. Toggle switch 74 is in its left position—pointing toward first status light 78. First moving panel 26 is in its low position. First status light 78 is illuminated, while second status light 80 is dark. This indicates that first moving panel 26 is in its low position.

Second toggle switch 76 is in its right position—pointing toward fourth status light 84. Fourth status light 84 is illuminated while third status light 82 is dark. This indicates that second moving panel 28 is in its high position.

When the user moves a toggle switch, the control system causes the panels to move and the status lights show when the motion is completed. As an example, consider the case where the user flips first toggle switch 74 to the right—toward second status light 80. This causes the first linear actuator to begin moving (causing the first moving panel 26 to start moving from its low position to its high position). With the jackscrew-type actuators, the motion is not fast. It may take 5 seconds for the first moving panel 26 to move from its low position to its high position. Once the panel starts moving up, first status light 78 goes out. Second status light 80 remains dark—which tells the user that the panel is in transit. Once the first moving panel reaches its high position, second status light 80 will illuminate. An analogous process occurs for second toggle switch 76 and status lights 82 and 84.

Motion can be controlled in many different ways but the use of industrial limit switches is a very rugged way and it is therefore used in the preferred embodiments. Returning to FIG. 3, the position of these limit switches will be explained. Left upper limit switch bracket 31 mounts a limit switch that is used to stop the upward travel of first moving panel frame 46 (The reader should recall that FIG. 3 shows the back of the inventive sign, so the left upper limit switch 31 appears on the right side in FIG. 3). Left lower limit switch bracket 33 mounts a limit switch that is used to stop the downward travel of first moving panel frame 46.

Right upper limit switch bracket 35 mounts a limit switch that is used to stop the upward travel of second moving panel frame 48. Right lower limit switch bracket 37 mounts a limit switch that is used to stop the downward travel of second moving panel frame 48. Electrical cables are provided to each of these limit switches as shown in the view. The electrical cables join into power and control cable 66—which leads back to the control box.

Figure 10:
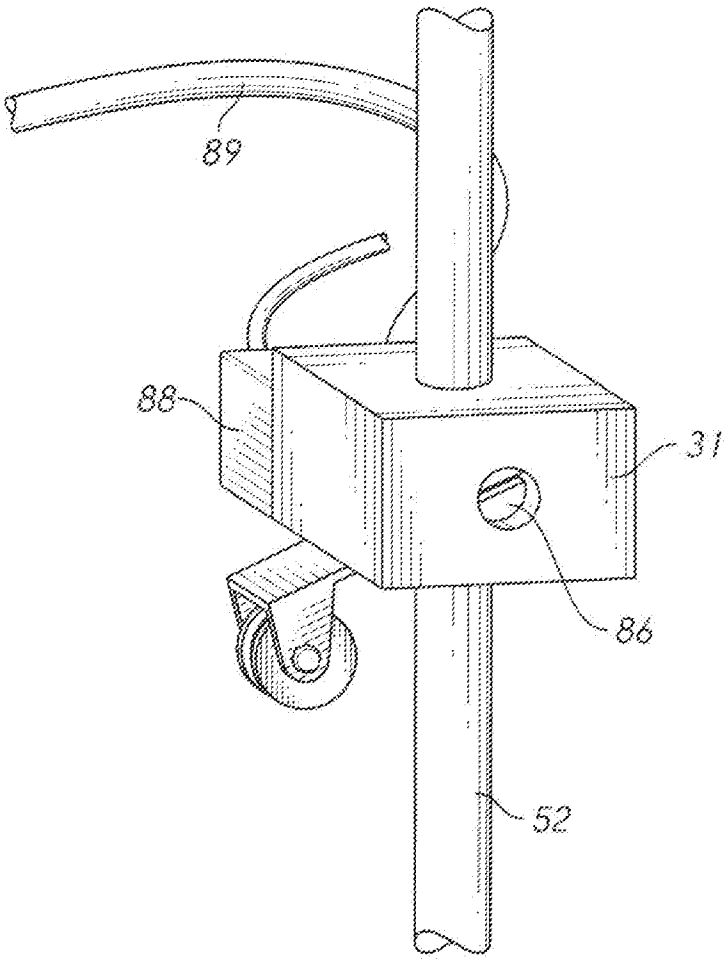
FIG. 10 is a perspective view, showing a limit switch bracket and its associated limit switch.

FIG. 10 shows left upper limit switch bracket 31 in more detail. Left upper limit switch 88 is mounted on this bracket. In this example, the limit switch includes a moving arm with a roller-contact on one end. The switch is normally closed and it opens when contact is made by first moving panel frame 46 running into the moving arm. The bracket 31 slides along linear guide 52. Its position is fixed by tightening set screw 86. Thus, in this example, the position of the limit switch can be adjusted and then secured. The three other limit switch brackets 33,35,37 are also adjusted and secured in the same manner. Each of these three other limit switch brackets mount a normally closed limit switch.

Figure 11:
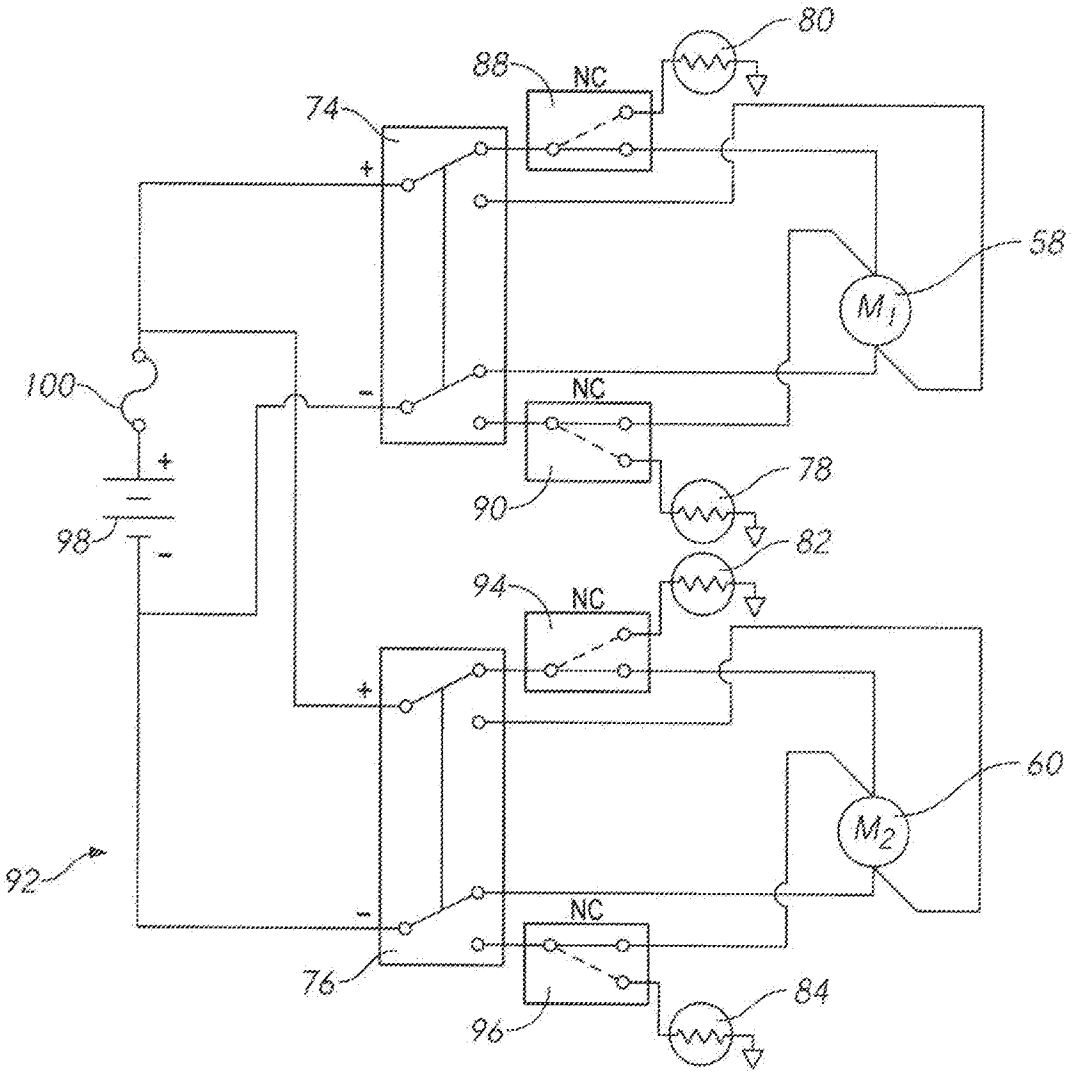
FIG. 11 is a schematic view, showing an exemplary analog control system that may be used to operate the inventive sign.

FIG. 11 depicts an exemplary analog control circuit that can be housed within the control box and used to control the position of the moving panels. Power source 98 provides 12V DC to operate the motor in first linear actuator 58 (M1) and the motor in second linear actuator 60 (M2). Breaker 100 provides circuit protection.

As for all such analog circuit diagrams, the depiction in FIG. 11 shows a particular "state." That state is (1) First toggle switch 74 has just been thrown to move the first moving panel to the high position; (2) Second toggle switch 76 has just been thrown to move the second moving panel to the high position; and (3) Each moving panel has just moved away from its low position and is moving toward its high position.

The reader will note that all four indicator lights 78,80, 82,84 are unpowered in this state (extinguished). The upper pole ("upper" and "lower" being understood with respect to the orientation of the view) of first toggle switch 74 is providing +12V through left upper limit switch 88 to the upper contact of the motor M1 (driving first linear actuator 58). The lower contact of motor M1 provides a ground return path through the lower pole of first toggle switch 74. Thus, motor M1 is driven in a first direction and first linear actuator 58 drives the first moving panel upward.

The same current path is occurring for motor M2. The upper pole of second toggle switch 76 is providing +12V through right upper limit switch 94 to the upper contact of the motor M2 (driving second linear actuator 60). The lower contact of motor M2 provides a ground return path through the lower pole of second toggle switch 76. Thus, motor M2 is driven in a first direction and second linear actuator 60 drives the second moving panel upward.

When the first moving panel reaches the upper extent of its travel it contacts the moving arm on left upper limit switch 88 and the normally-closed limit switch opens. The circuit to motor M1 is broken and motion ceases. Left upper limit switch 88 "makes" its alternate contact feeding voltage to second status light 80 (shown by the dashed line in the limit switch). Second status light 80 illuminates.

When the second moving panel reaches the upper extent of its travel it contacts the moving arm on right upper limit switch 94 and the normally-closed limit switch opens. The circuit to motor M2 is broken and motion ceases. Right upper limit switch 94 "makes" its alternate contact feeding voltage to third status light 82 (shown by the dashed line in the limit switch). Third status light 82 illuminates.

Once the motion of the two moving panels has stopped in the high position nothing will change until the toggle switch positions are changed. To move the moving panels to the low position, the user flips both toggle switches 74, 76. The upper pole of toggle switch 74 then provides +12V to the lower contact of motor M1. The lower pole of toggle switch 74 provides a ground return path from the upper contact of motor M1, through left lower limit switch 90. This current path drives motor M1 in a second direction and first linear actuator 58 drives the first moving panel downward.

The upper pole of toggle switch 76 provides +12V to the lower contact of motor M2. The lower pole of toggle switch 76 provides a ground return path from the upper contact of motor M2, through right lower limit switch 96. This current path drives motor M2 in a second direction and second linear actuator 60 drives the second moving panel downward.

The downward motion of both moving panels continues until the lower limit switches are opened. The first moving panel eventually makes contact with left lower limit switch 90 and this normally-closed switch opens. Power to the motor M1 is lost and motion stops. The alternate contact of left lower limit switch 90 provides voltage to first status light 78, which illuminates.

The second moving panel eventually makes contact with right lower limit switch 96 and this normally-closed switch opens. Power to motor M2 is lost and the motion of the second moving panel stops. The alternate contact of right lower limit switch 96 provides voltage to fourth status light 84, which illuminates. A stable state is then again achieved. Nothing will change until a position of the toggle switches is changed.

The reader will thereby understand how the operation of control circuit 92 in FIG. 11 can control the motion of the moving panels as desired by a user. These operations could also be carried out using a programmable processor—such as a programmable logic controller. A dedicated processor could also be used.

Those skilled in the art will also realize that an operative embodiment could be created without separate limit switches. Some linear actuators include internal position-indicating switches. Some of these actuators have a single limit switch indicating a "home" position (usually fully retracted). A rotary encoder then supplies a pulse train as the motor actuates to drive the extending portion of the actuator away from the home position. A desired amount of extension can be set via using a processor to count the pulses.

This type of arrangement eliminates the need for external limit switches and wiring. Many other position control and motion techniques could be used in the invention. Options include optical position sensors and Hall Effect (magnetic) position sensors.

Figure 12:
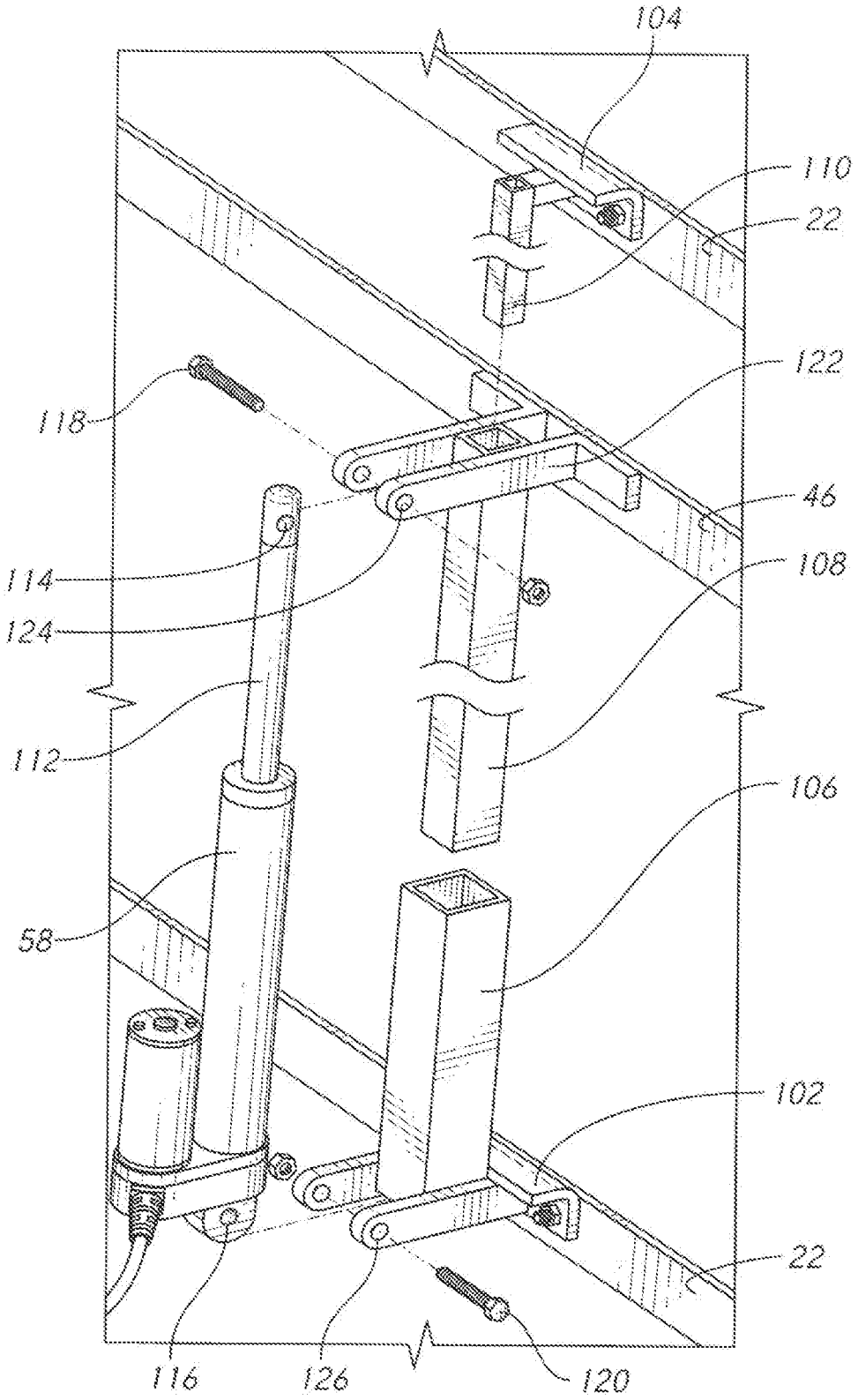
FIG. 12 is an exploded perspective view, showing an alternate embodiment of a linear guide.
Figure 13:
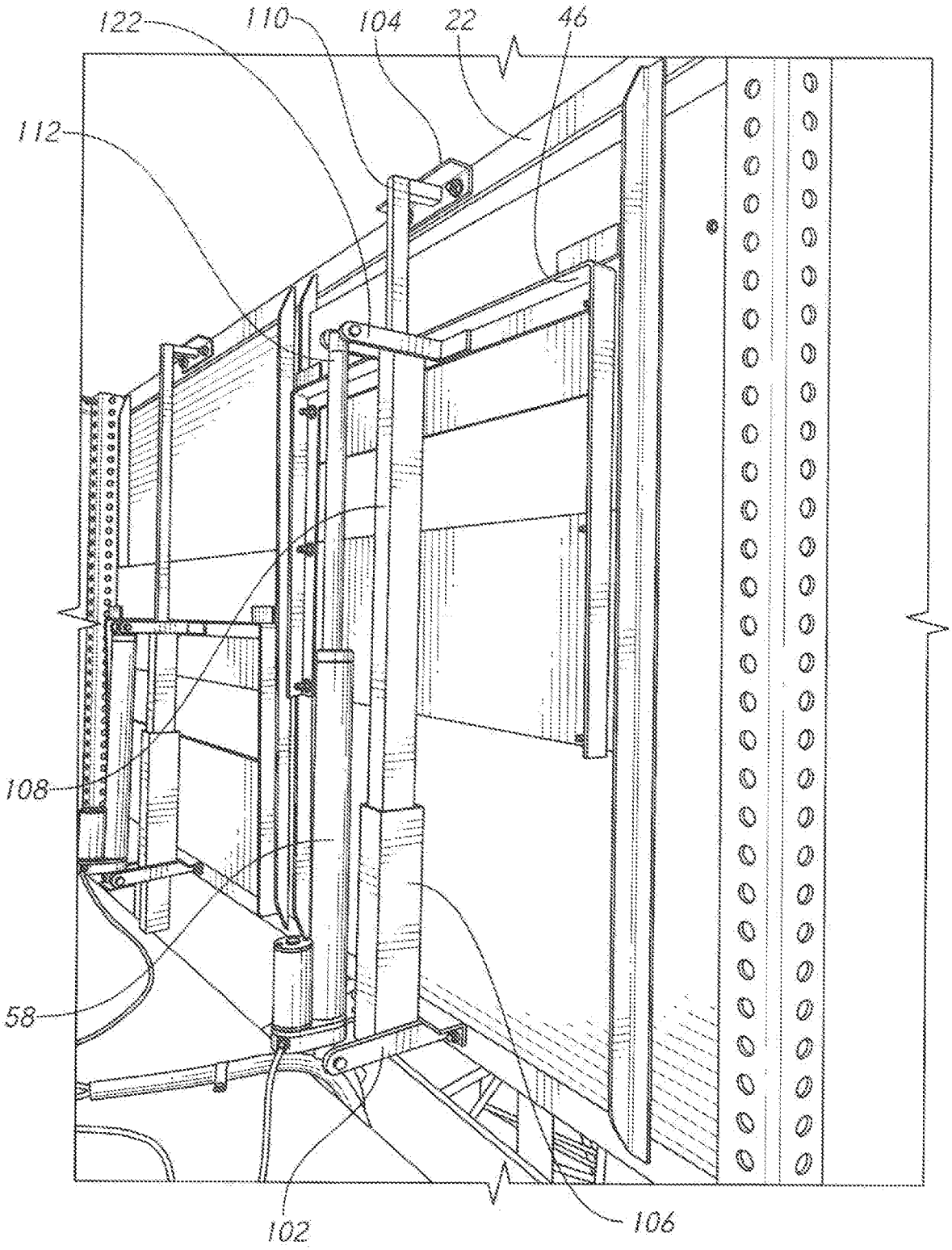
FIG. 13 is a perspective view, showing the components of FIG. 12 in an assembled state.

The embodiment depicted in FIG. 3 uses aluminum rods in the role of linear guides 52. The rods are effective in this role, but they also require the use of numerous separate brackets 54,59. FIGS. 12 and 13 depict an additional embodiment in which telescoping square tubing is used as a linear guide.

FIG. 12 shows an exploded perspective view. The view shows the area of first moving panel frame 46. The components are attached to sign chassis 22 as for the prior example. The reader will note the break in the vertical lines of the view. These breaks were added in order to fit all the important features on a single page. Lower bracket 102 is connected to sign chassis 22. It incorporates lower square tube 106. The lower bracket also incorporates a pair of rearward extending arms configured to mount the linear actuator. These arms include a transverse hole 126.

First linear actuator 58 includes a protruding boss on its lower portion. This boss includes a transverse hole 116. In order to connect first linear actuator 58 to lower bracket 102, the assembler aligns hole 116 with hole 126 and then passes fastener 120 through the aligned holes. The fastener is secured in place using a lock nut, cottar key, or other suitable component.

Extension rod 112 moves in and out of the body of the linear actuator (such as via the operation of a jackscrew mechanism). The distal end of the extension rod includes a transverse hole 114. Moving panel bracket 122 is connected to first moving panel frame 46. Like the lower bracket, moving panel bracket 122 includes a pair of rearward extending arms with a transverse hole 124. Extension rod 112 is connected to moving panel bracket 122 by aligning holes 114 and 124, then passing fastener 118 through the holes and securing it in place.

The linear guide in this embodiment assumes the form of telescoping square tubing. The reader will note that middle square tube 108 extends downward from moving panel bracket 122. The outer dimension of middle square tube 108 is selected to be a smooth sliding fit within the inner dimension of lower square tube 106. Those skilled in the art will know that extruded square tubing is available in a wide range of sizes and wall thicknesses. It is possible to create the desired sliding fit using off-the-shelf square tubing.

Guidance for the motion of the upper end of middle square tube 108 is provided by upper square tube 110. Upper square tube 110 extends downward from upper bracket 104—which is attached to the upper portion of sign chassis 22. The outer dimension of upper square tube 110 is sized to be a smooth sliding fit within the inner dimension of middle square tube 108. The reader will thereby appreciate that the three different sizes of square tubing create a telescoping arrangement that guides the vertical motion of moving panel frame 46.

FIG. 13 provides a perspective view of the linear guides and linear actuators in an assembled state. This view allows the reader to properly perceive the vertical dimensions of the telescoping pieces of square tubing. First moving panel frame 46 is shown in its high position, whereas the second moving panel frame is shown in its low position. Lower square tube is made long enough so that the lower portion of middle square tube 108 does not lift free of the upper portion of lower square tube 106 when first moving panel frame 46 stops in its high position. Similarly, upper square tube 110 is made long enough so that the upper portion of middle square tube 108 remains engaged with upper square tube 110 when first moving panel frame 46 is in its low position. In fact, the reader can observe the low position of the assembly by looking at the second linear actuator and its accompanying linear guide arrangement in the background of FIG. 13 (The second moving panel frame is shown in the low position).

Figure 14:
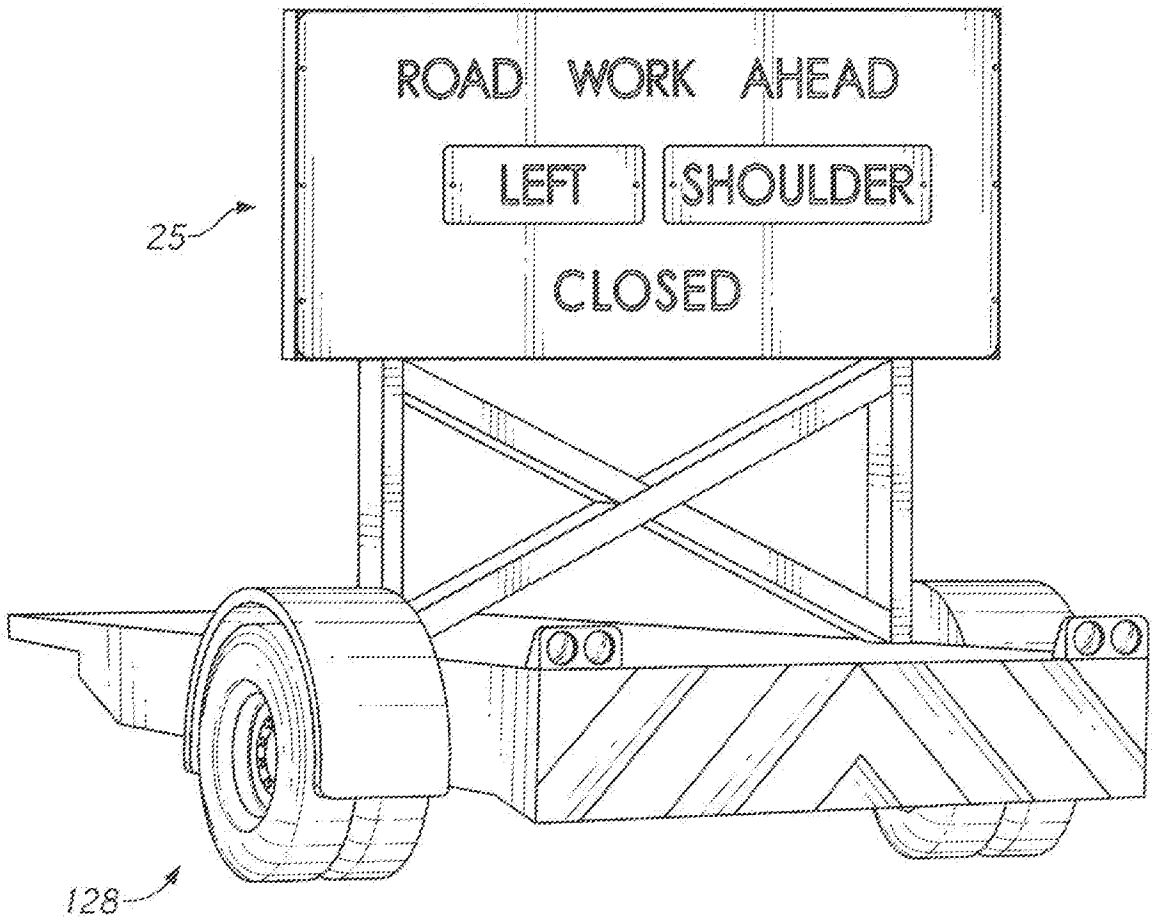
FIG. 14 is a perspective view, showing an embodiment of the inventive sign mounted on a trailer.

The reader should bear in mind that the inventive variable text sign is not constrained to any particular vehicle or any particular application. As an example, FIG. 14 shows an embodiment where variable text sign 25 is configured to mount on a towed trailer 128.

Because the inventive sign will be left in the weather for extended periods, the selection of materials becomes important. Aluminum is a good choice for the chassis and other framing components, since its formation of a surface oxide coating provides good protection. The aluminum may also be treated or coated to extend its life. Other metals can be used as well, including painted or coated mild steel. Fiber reinforced polymers could also be used.

The sign material itself will typically include one or more reflective coatings such as are commonly used on traffic signs and as standardized by AASHTO. It is also possible to incorporate illuminated lettering or other elements in both the fixed and moveable portions of the inventive sign.

The linear actuators described in the embodiments are of the jackscrew-type, but the invention is not limited to this type of actuator. Many other types of linear actuators could be used, including hydraulic cylinders, air cylinders, and rack-and-pinion mechanisms.

Although the preceding descriptions contain significant detail, they should not be construed as limiting the scope of the invention but rather as providing illustrations of the preferred embodiments of the invention. Those skilled in the art will know that many other variations are possible without departing from the scope of the invention. Accordingly, the scope of the invention should properly be determined with respect to the claims that are ultimately drafted rather than the examples given.

Having described my invention, I claim:

1. A variable text sign, comprising:

(a) a fixed panel including a first window and a second window;

(b) a first moving panel located behind said fixed panel, said first moving panel having a first variable message area and a second variable message area;

(c) said first moving panel being movable from a first position to a second position, wherein said first variable message area is visible through said first window when said first moving panel is in said first position, and wherein said second variable message area is visible through said first window when said first moving panel is in said second position;

(d) a second moving panel located behind said fixed panel, said second moving panel having a third variable message area and a fourth variable message area;

(e) said second moving panel being movable from a first position to a second position, wherein said third variable message area is visible through said second window when said second moving panel is in said first position, and wherein said fourth variable message area is visible through said second window when said first moving panel is in said second position;

(f) a first linear actuator configured to selectively move said first moving panel from said first position to said second position;

(g) a first linear guide configured to guide said motion of said first moving panel from said first position to said second position;

(h) a second linear actuator configured to selectively move said second moving panel from said first position to said second position;

(i) a second linear guide configured to guide said motion of said second moving panel from said first position to said second position; and (j) a control system configured to control the motion of said first and second linear actuators.

2. The variable text sign as recited in claim 1, wherein said linear guides comprise vertically-oriented rods.

3. The variable text sign as recited in claim 2, wherein said first and second linear actuators are jackscrew actuators powered by electric motors.

4. The variable text sign as recited in claim 3 wherein said first and second positions of said first and second moving panels are set by limit switches.

5. The variable text sign as recited in claim 1, wherein said linear guides comprise nested square tubing.

6. The variable text sign as recited in claim 1, wherein said first and second linear actuators are jackscrew actuators powered by electric motors.

7. The variable text sign as recited in claim 1 wherein said control system includes a control box that is remotely located with respect to said fixed panel.

8. The variable text sign as recited in claim 7, wherein said control box includes a power input cable configured to plug into a vehicle on which said variable text sign is mounted.

9. The variable text sign as recited in claim 1 wherein power is provided to said first and second linear actuators from a vehicle on which said variable text sign is mounted.

10. The variable text sign as recited in claim 8 wherein power is provided to said first and second linear actuators from a vehicle on which said variable text sign is mounted.

11. A variable text sign, comprising:

(a) a sign chassis;

(b) a fixed panel including a first window and a second window;

(c) a first moving panel located behind said fixed panel, said first moving panel having a first variable message area and a second variable message area;

(d) said first moving panel being movable from a low position to a high position, wherein said first variable message area is visible through said first window when said first moving panel is in said low position, and wherein said second variable message area is visible through said first window when said first moving panel is in said high position;

(e) a second moving panel located behind said fixed panel, said second moving panel having a third variable message area and a fourth variable message area;

(f) said second moving panel being movable from a low position to a high position, wherein said third variable message area is visible through said second window when said second moving panel is in said low position, and wherein said fourth variable message area is visible through said second window when said first moving panel is in said high position;

(g) a first linear actuator configured to selectively move said first moving panel from said low position to said high position;

(h) a first linear guide configured to guide said motion of said first moving panel from said low position to said high position;

(i) a second linear actuator configured to selectively move said second moving panel from said low position to said high position;

(j) a second linear guide configured to guide said motion of said second moving panel from said low position to said high position;

(k) said fixed panel including a first fixed message area;

(l) said first linear guide including a first telescoping assembly of square tubes, having a lower square tube connected to said sign chassis, a middle square tube connected to said first moving panel, and an upper square tube connected to said sign chassis; and (m) said second linear guide including a second telescoping assembly of square tubes, having a lower square tube connected to said sign chassis, a middle square tube connected to said second moving panel, and an upper square tube connected to said sign chassis.

12. The variable text sign as recited in claim 11, wherein for each of said linear guides said telescoping assembly of square tubes said lower square tube is largest and said upper square tube is smallest.

13. The variable text sign as recited in claim 11, wherein:

(a) said first linear actuator is connected to said middle square tube in said first telescoping assembly of square tubes; and (b) said second linear actuator is connected to said middle square tube in said second telescoping assembly of square tubes.

14. The variable text sign as recited in claim 11, wherein said first and second linear actuators are jackscrew actuators powered by electric motors.

15. The variable text sign as recited in claim 11, further comprising a control system configured to control the motion of said first and second linear actuators.

16. The variable text sign as recited in claim 15 wherein said high and low positions of said first and second moving panels are set by limit switches.

17. The variable text sign as recited in claim 15 wherein said control system includes a control box that is remotely located with respect to said fixed panel.

18. The variable text sign as recited in claim 17, wherein said control box includes a power input cable configured to plug into a vehicle on which said variable text sign is mounted.

19. The variable text sign as recited in claim 18 wherein power is provided to said first and second linear actuators from a vehicle on which said variable text sign is mounted.

20. The variable text sign as recited in claim 11 wherein power is provided to said first and second linear actuators from a vehicle on which said variable text sign is mounted.

* * * * *